United States Patent [19]

Rössler

[11] 4,098,411

[45] Jul. 4, 1978

[54] COUPLING FOR MODEL VEHICLES

[76] Inventor: Heinz Rössler, Dr.-Sylvester-Strasse 18, 5034 Salzburg-Morzg, Austria

[21] Appl. No.: 782,083

[22] Filed: Mar. 28, 1977

[51] Int. Cl.[2] ..... A63H 19/00

[52] U.S. Cl. ..... 213/75 TC; 46/216

[58] Field of Search ..... 213/80, 81, 91, 92, 213/101, 176, 177, 185, 186, 187, 75 R, 75 TC; 46/216, 217, 218

[56] References Cited

U.S. PATENT DOCUMENTS

| | | | |
|---|---|---|---|
| 3,518,790 | 7/1970 | Zamarra | 213/75 R |
| 3,831,776 | 8/1974 | Antonik | 213/75 TC |

*Primary Examiner*—Trygve M. Blix
*Assistant Examiner*—D. W. Keen
*Attorney, Agent, or Firm*—Fleit & Jacobson

[57] ABSTRACT

A coupling member for model railway rolling stock comprises an anchoring member for attachment to the end of a model vehicle, a rigid bifurcated member extending from said anchoring member and a resilient tongue extending substantially parallel to the bifurcated member at one side thereof and at a spacing therefrom. The tongue is flexible away from said bifurcated member and carries a latch which is directed towards said bifurcated member. The other side of the bifurcated member is recessed to define a catch. When the coupling member is engaged with an identical counter-coupling, the latch of the counter-coupling is engaged in said catch of the coupling member, one bifurcation of the counter-coupling is engaged in a receptacle defined by the bifurcations of the coupling member, and the other bifurcation of the counter-coupling is engaged in the spacing between the bifurcated member and resilient tongue of the coupling member.

11 Claims, 5 Drawing Figures

COUPLING FOR MODEL VEHICLES

The invention relates to a coupling for model vehicles, particularly model rail vehicles, comprising a supporting member to be secured to a vehicle or a locomotive, and a coupling member which is formed with a receptacle suitable for the entry of a correspondingly constructed counter-coupling member, a coupling hook, and a resilient lug which is movable in a substantially horizontal plane and has at its free end a ramp with an obliquely forwardly and outwardly directed guide feeler.

Such a coupling is known. The coupling member is in this case connected to the mounting member by a resilient tongue. Laterally opposite the receptacle in the coupling member for the entry of a correspondingly constructed counter-coupling member, the coupling member carries a resilient lug which partially closes this receptacle. The coupling hook as well as the resilient lug are each formed with a ramp. The ramp of the hook as well as the ramp of the resilient lug each merge with an outwardly directed guide feeler. The guide feeler of the resilient lug is extended outwardly in comparison with the guide feeler of the hook. The two guide feelers extend in superposed different horizontal planes. The guide feeler of the hook lies in the lower plane and the guide feeler of the resilient lug in the upper plane. In this way a secure coupling is ensured even if the rails are unevenly positioned. Further advantages of such a coupling are as follows. Since the coupling member is disposed at the outermost end of a resilient tongue, S-curves of small radii can be negotiated without the danger of uncoupling and without making additional constructional elements necessary for securing the coupled condition. Finally, the coupling permits shunting operations to be carried out in the uncoupled condition without two abutting couplings becoming coupled to each other. If, however, a vehicle is made to approach another vehicle with a slight jerk or impact, the couplings will readily and securely interengage. By reason of the resilient tongue, the so-called shivering-effect can no longer occur. With this known coupling, however, the possibility of manual uncoupling by simply lifting one of the two vehicles has been lost.

The invention is based on the problem of improving the known coupling so that manual uncoupling by simply lifting one of the two vehicles is made possible.

The solution of the set problem by means of the invention consists in a coupling of the aforementioned kind in that the resilient lug carries the coupling hook and that the receptacle consists of a coupling fork which is rigidly connected to the supporting member and on the outside of which there is provided a coupling catch. The coupling hook carried by the resilient lug engages behind the coupling catch of the coupling fork of the counter-coupling of the adjacent vehicle, which coupling fork is rigidly connected to the mounting member. In the coupled condition with the coupling of the adjacent vehicle there is thus formed a unit that cannot buckle sidewardly from the longitudinal axis. Further, the coupling according to the invention permits HO model railway vehicles to be driven buffer to buffer, i.e. at a spacing of only 0.8 mm between the buffers, namely on the conventional small rail radii of 358 mm. This constitutes a further advance in achieving a faithful model. A very special advantage arising out of the solution to the set problem is that a vehicle can be lifted from the rails without the other vehicle being lifted with it or the need for undoing the coupling first.

In a preferred embodiment of the invention, the resilient lug comprises a downwardly extending uncoupling pin at its free end. In a further embodiment according to the invention, the resilient lug may comprise a further downwardly extending uncoupling pin which is staggered towards the supporting member. The coupling according to the invention therefore also permits vehicles to be uncoupled from the switch box. By pressing a key at the switch box, a rhomboidal segment disposed between the rails is lifted. The coupled vehicle is subsequently carefully driven against the lifted segment. The rhomboidal segment splays the downwardly directed pins outwardly. This releases the couplings. One vehicle remains behind and the other can be moved away.

One embodiment of the invention will now be described by way of example with reference to the drawing. In the drawing.

Figure 1:
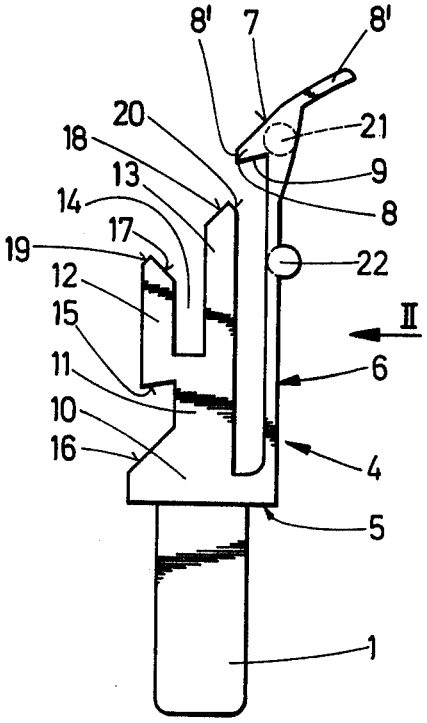
FIG. 1 is a plan view of a coupling according to the invention.
Figure 2:
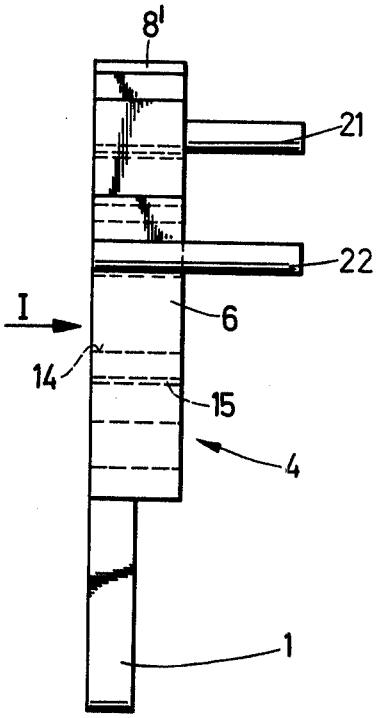
FIG. 2 is a side elevation of FIG. 1.
Figure 3:
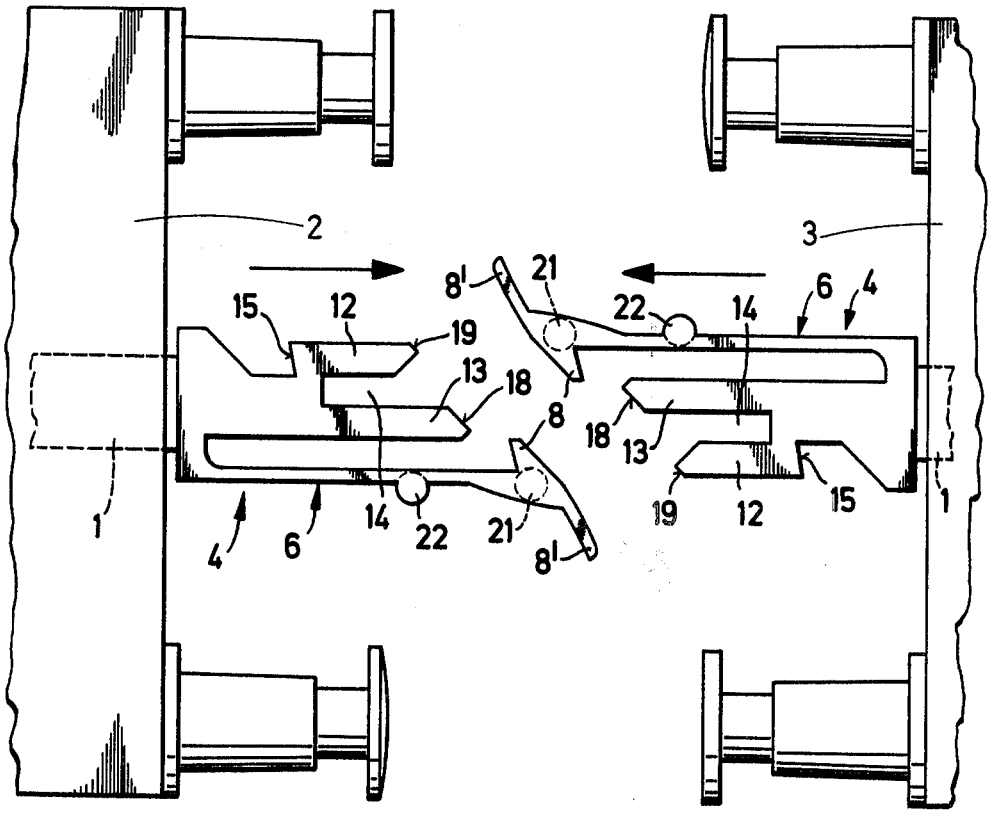
FIG. 3 shows the position of the coupling and counter-coupling of adjacent vehicles prior to coupling.

As will be evident from FIGS. 1 and 2, the coupling consists of a supporting member 1 by means of which the coupling can be secured in any desired manner to a vehicle 2 or 3, even in the form of a replacement coupling, as shown in FIG. 3. Further, the coupling consists of a coupling member 4. Whereas the mounting member 1 is constructed substantially as a flat rectangle, the coupling member 4 is wider as well as higher. First of all, it comprises a supporting plate 5 extending in a vertical plane. A resilient lug 6 which is movable in a substantially horizontal plane is provided on the outside of the supporting plate 5. The resilient lug 6 carries a ramp 7 at its free end. The ramp 7 is elongated by an obliquely forwardly and outwardly directed guide feeler 8'. On the inside of the resilient lug 6, the ramp 7 merges with the coupling hook 8 which has an undercut 9.

Figure 4:
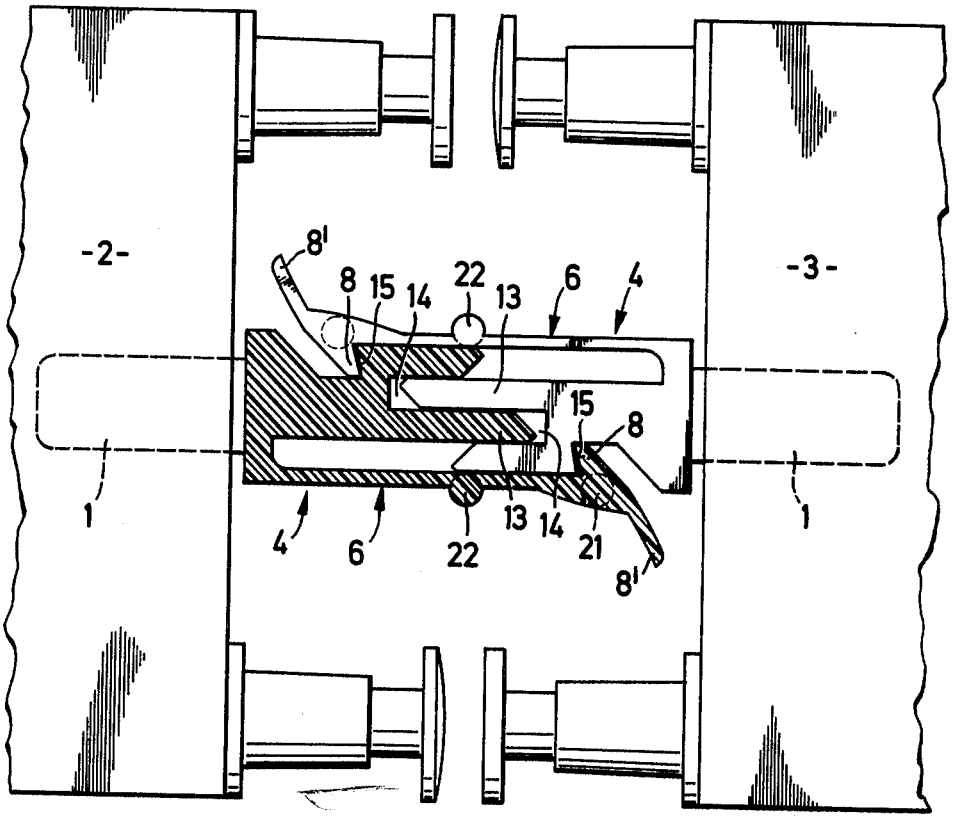
FIG. 4 shows the two adjacent vehicles short-coupled according to the invention.

The supporting plate 5 carries a guide plate 10 at a lateral spacing from the resilient lug 6. The guide plate 10, supporting plate 5 and supporting member 1 form a rigid unit. The guide plate 10 is for the most part formed as a coupling fork consisting of a wider stem 11 and two fork prongs 12, 13. Between the prongs 12, 13 there is the receptacle 14 intended for the entry of a correspondingly constructed counter-coupling member. The fork prong 12 is shorter than the prong 13 and the latter is shorter than the resilient lug 6. The rear shoulder of the shorter prong 12 together with the lateral flank of the stem 11 of the fork defines a coupling catch 15 for the coupling hook 8 of a correspondingly constructed counter-coupling member of an adjacent vehicle, as will be best seen from FIG. 4. The transition from the stem 11 to the supporting plate 5 is formed as a tapered surface 16. The coupling fork 11, 12, 13, 14 thus extends at a spacing parallel to the resilient lug 6. The end faces of the fork prongs 12, 13 are partially bevelled inwardly, i.e. towards the receptacle 14, over a larger section 17, 18 and partially outwardly. These bevelled faces are referenced 19, 20.

At its free end, the resilient lug 6 has a downwardly extending pin 21. A further downwardly extending pin 22 is staggered towards the supporting member 1 and mounted on the resilient lug 6. The pins 21, 22 serve as uncoupling pins as will be shown with reference to FIG. 5.

For coupling purposes, two adjacent vehicles 2, 3 are firstly brought into the position shown in FIG. 3. If, now, a vehicle fitted with a coupling according to the invention approaches another vehicle that is likewise equipped with such a coupling, then the guide feelers 8' of the two coupling members 4 will first of all ride onto one another. The guide feelers 8' slide on one another and bring the coupling members 4 to the coupling position. The guide feeler 8' will first of all ride on the bevel 18 of the fork prong 13 and then along the bevel 19 of the fork prong 16. In this way the resilient lug 6 is guided onto the outside of the coupling member 4. The vehicles will now come closer to one another and, as evident from FIG. 4, the longer prong 13 will enter the receptacle 14 and the shorter prong 12 will enter the gap formed by the spacing between the prong 13 and the resilient lug 6. In the final coupled condition, the coupling hook 9 will engage behind the coupling catch 15.

Figure 5:
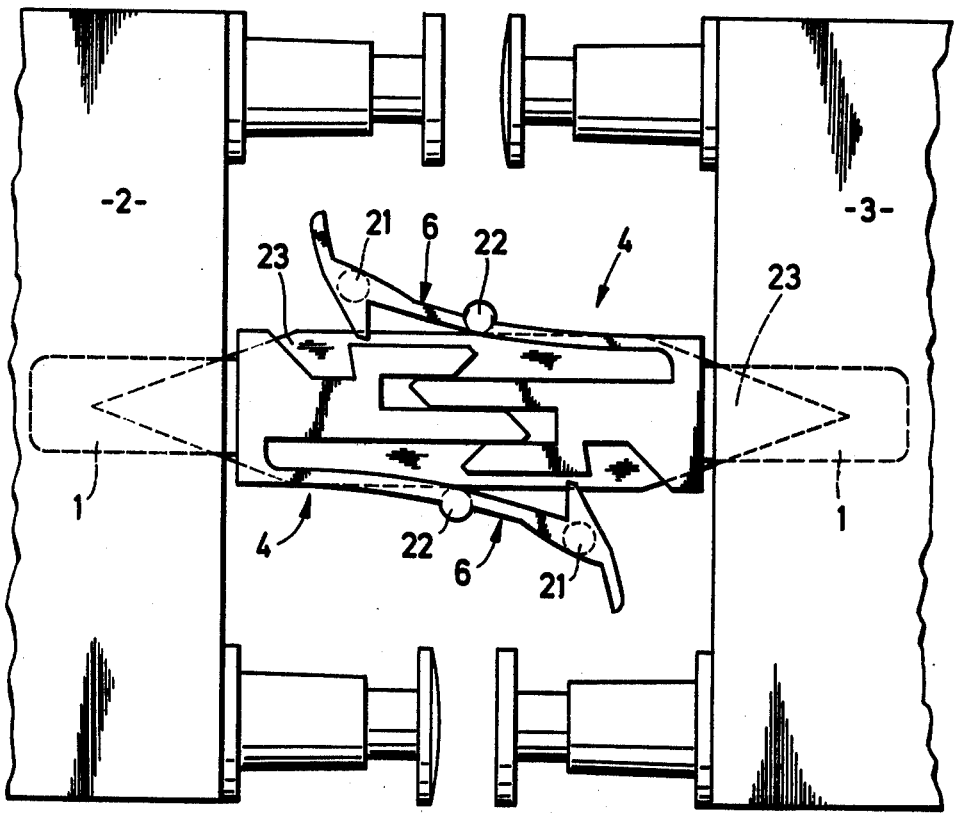
FIG. 5 shows the couplings according to the invention of adjacent vehicles after being uncoupled with the uncoupling member.

Manual uncoupling can be effected by simply lifting one of the vehicles. Automatic uncoupling by pressing a key at the switch box takes place in that the key pressure causes a rhomboidal uncoupling member 23 to be lifted between the rails (see FIG. 5). The coupled vehicles are subsequently carefully driven against the uncoupling member 23. The rhomboidal uncoupling member 23 then spreads the downwardly projecting pins 21, 22 outwardly and thereby releases the couplings, as shown in FIG. 5. One vehicle remains stationary and the other can be driven away.

I claim:

1. A coupling for model vehicles, particularly model rail vehicles, comprising a supporting member to be secured to a vehicle or a locomotive, and a coupling member which is formed with a receptacle suitable for the entry of a correspondingly constructed counter-coupling member, a coupling hook, and a resilient lug which is movable in a substantially horizontal plane and has at its free end a ramp with an obliquely forwardly and outwardly directed guide feeler, characterised in that the resilient lug (6) carries the coupling hook (8) and that the receptacle (14) comprises a coupling fork (11, 12, 13) which is rigidly connected to the supporting member and on the outside of which there is provided a coupling catch (15).

2. A coupling according to claim 1, characterised in that the coupling fork (11, 12, 13) extends parallel to the resilient lug (6) at a spacing at least somewhat broader and somewhat longer than the inner prong (13) of the fork.

3. A coupling according to claim 1, characterised in that the fork has an inner prong (13) formed longer than an outer prong (12).

4. A coupling according to claim 1, characterised in that the fork has fork prongs (12, 13) with end faces partially bevelled inwardly over a larger section (17 or 18) and partially (19,20) outwardly.

5. A coupling according to claim 1, characterised in that the resilient lug (6) comprises a downwardly extending uncoupling pin (21) at its free end.

6. A coupling according to claim 5, characterised in that the resilient tongue (6) comprises a further downwardly extending uncoupling pin (22) which is staggered towards the supporting member (1).

7. A coupling according to claim 1, characterised in that it consists of an elastic material.

8. A coupling according to claim 7, characterised in that the elastic material is a plastic.

9. A coupling according to claim 1 characterised in that the coupling member, when engaged with a correspondingly constructed counter-coupling member set in an opposite direction, is rigidly interconnected therewith.

10. A coupling according to claim 1, characterised in that the coupling member, when secured to a vehicle, is substantially immovable in a direction parallel to the longitudinal axis of the vehicle.

11. A coupling member for model railway rolling stock comprising an anchoring member for attachment to the end of a model vehicle, a rigid bifurcated member extending from said anchoring member, the bifurcations defining a receptacle between each other, and a resilient tongue extending substantially parallel to said bifurcated member at one side thereof and a spacing therefrom, said tongue being flexible away from said bifurcated member, wherein said tongue carries a latch which is directed towards said bifurcated member and the other side of said bifurcated member is recessed to define a catch, whereby when said coupling member is engaged with an identical counter-coupling, the latch of said counter-coupling is engaged in said catch of said coupling member, one bifurcation of said counter-coupling is engaged in said receptacle of said coupling member, and the other bifurcation of said counter-coupling is engaged in said spacing between said bifurcated member and said resilient tongue of said coupling member.

* * * * *